United States Patent [19]

Anderson

[11] 4,267,614

[45] May 19, 1981

[54] LIFE-SAVING APPARATUS

[76] Inventor: Axel Anderson, 5333 Sherbrooke St. East, Apt. 1013, B, Montreal Quebec, Canada, H1T 3W2

[21] Appl. No.: 90,565

[22] Filed: Nov. 2, 1979

[51] Int. Cl.[3] ..... B63C 9/06

[52] U.S. Cl. ..... 9/4 R

[58] Field of Search ..... 9/1.1, 3, 4 R, 4 A, 9/5, 6, 6.5, 11 R, 11 A

[56] References Cited

U.S. PATENT DOCUMENTS

| | | | |
|---|---|---|---|
| 637,940 | 11/1899 | Myers | 9/4 R |
| 671,185 | 4/1901 | Donvig | 9/4 R |
| 969,020 | 8/1910 | Woods | 9/4 R |
| 1,377,486 | 5/1921 | Johnson | 9/4 R |
| 1,657,614 | 1/1928 | Code | 9/4 R |
| 3,259,926 | 7/1966 | Otterman | 9/4 R |
| 3,813,717 | 6/1974 | Mousetis | 9/4 R |

*Primary Examiner*—Trygve M. Blix
*Assistant Examiner*—Jesus D. Sotelo

[57] ABSTRACT

A buoyant vessel in the shape of a rigid closed cylinder is disclosed to replace conventional lifeboats on a ship. The cylinder has a hermetically sealable door in its sidewall as well as portholes. It also has a rigid outer skin made of aluminum, an inner skin contiguous with the outer skin made of asbestos and a relatively thick layer of foam material contiguous with the inner skin to provide insulation and buoyancy. The interior of the vessel has two vertically spaced-apart circular rows of seats adjacent the side wall of the cylinder. The lower row adjacent the floor of the cylinder is upside up and the upper row is upside down so that, if the cylinder is overturned in heavy seas, the upper row will assume right side up position and vice-versa. To this end, the cylinder is symmetrical about its middle horizontal plane. Ventilation apertures are provided in the upper and lower surface of the cylinder respectively and a skeletal structure of hollow metal tubing is also provided. A support structure secured to the ship deck is also provided.

2 Claims, 2 Drawing Figures

LIFE-SAVING APPARATUS

FIELD OF THE INVENTION

The invention relates to a life-saving apparatus and has particular reference to a buoyant passenger carrying vessel used to escape from an endangered or sinking ship. The vessel disclosed herein is designed to replace conventional lifeboats.

BACKGROUND OF THE INVENTION

It is well known that conventional lifeboats can be woefully inadequate. Such open longboats are difficult to launch when the ship is listing to one side and may pound against the ship on a stormy sea. The danger is still present when such a boat is successfully launched with a full complement of escaping sailors or passengers: skill is required to keep the boat from capsizing in high waves and wind or smashing against other longboats. Moreover, the passengers are exposed to the elements and may suffer from exposure or die before they can be rescued. The same remarks apply to inflatable rafts.

OBJECTS OF THE INVENTION

It is therefore among the objects of the invention to provide a new and improved vessel to entirely replace the conventional lifeboat and inflatable rafts.

It is a prime object of the present invention to provide an unsinkable life-saving apparatus which does not need to be launched by conventional block and tackle when a ship is sinking.

It is still another object of the present invention to provide a life-saving apparatus which is designed to be safe for the passengers even when capsized in rough seas.

It is yet another object of the present invention to provide a life-saving apparatus which may be lifted out of the water by a helicopter or rescue ship.

SUMMARY OF THE INVENTION

The above and other objects of the invention are realized according to a preferred embodiment characterized by a vessel generally in the shape of a closed cylinder which is symmetrical about its middle horizontal plane so that it can be turned upside down. Snorkel-like ventilation apertures are provided in both end walls of the vessel so that the watertight interior of the vessel will be provided with fresh air regardless of what end wall of the cylinder is floating on the water.

Preferably, the vessel has a skeletal structure to give its rigidity. This structure may consist of a tubular framework having a central pole, radially projecting members extending within the end walls of the cylinder, round peripheral tube members within the junction of the end walls with the side wall, and additional poles, parallel to the central pole, extending within the side wall and interconnecting the peripheral tube members.

The outer skin of the vessel is preferably of suitable lightweight and strong metal such as aluminum. A layer of fire protecting material such as asbestos is preferably provided immediately under the outer skin. A layer of plastic foam material is provided in turn inwardly of the asbestos layer to increase buoyancy and ensure thermal insulation for the passengers inside the vessel. Finally, the inner surface of the vessel is preferably a rigid resin and glass fibre layer and this interior surface constitutes the "floor" and "ceiling" of the vessel, as well as the circular side wall.

Inside the vessel, the side wall of the cylinder has a step adjacent each end wall which form two continuous rows of circularly-arranged rigidly secured molded seats. The seats of one row are reversed relative to the seats of the other row. Therefore, the seats adjacent the ceiling are upside down so that if the vessel is flipped over in strong seas, they assume the right side up position.

A waterproof door is provided in the side wall of the cylinder as are portholes at spaced intervals.

The above will be more clearly understood by referring to a preferred embodiment of the invention, illustrated by way of the accompanying drawings in which:

BRIEF DESCRIPTION OF THE DRAWINGS

Like numerals refer to like elements throughout the drawings.

DETAILED DESCRIPTION OF THE INVENTION

Figure 1:
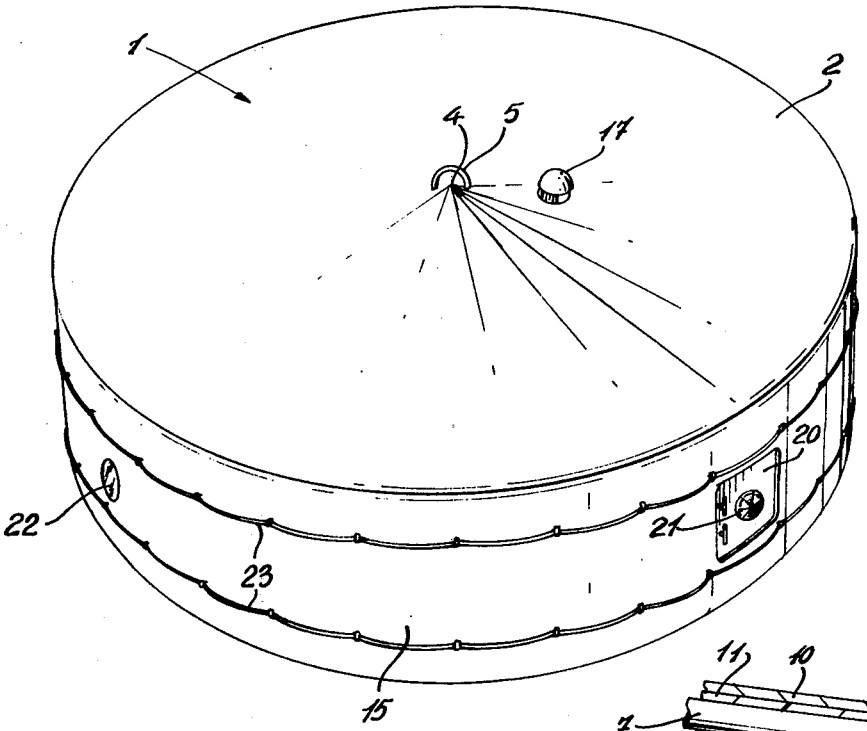
FIG. 1 is a perspective view of the vessel according to the invention.
Figure 3:
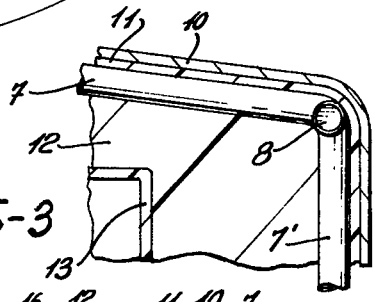
FIG. 3 is an enlarged sectioned view of the top right hand corner of FIG. 2 showing a portion of the framework.

The life-saving vessel, generally designated as 1, is in the shape of a closed cylinder having end walls 2 and 3, joined by a cylindrical side wall 15, and each sloping exteriorly and conically to a central point 4. Both central points 4 are provided with a rigidly secured ring 5 to which may be attached the hoisting cable of a rescue ship or helicopter.

The vessel 1 has a skeletal structure consisting of hollow metal tubing. A central pole 6 is welded or otherwise secured to four or more radially extending members 7 equally, angularly spaced apart from each other and extending within the respective end walls of the cylinder respectively and defining the exterior sloping outer end surfaces of the cylinder 1. Two annular tubing members 8 and 9 (shown only in cross-section in the figures), extend within the junction of the side wall 15 with the respective end walls 2 and 3, and are rigidly secured to the outer ends of the respective radially extending members 7, and to additional poles 7' which are parallel to central pole 6 and extend within side wall 15.

The outer surface, or skin 10, of the vessel is made of a strong, lightweight metal such as an aluminum alloy. An inner layer 11, again completely covering the vessel, is made of a fire protecting material such as asbestos to prevent its destruction by fire. Asbestos layer 11 is contiguous with the inside surface of outer skin 10.

A third layer 12 is provided of substantially greater thickness than the first two layers 10 and 11 and is made of plastic foam material to assure thermal retention inside the vessel and also to provide increased buoyancy to the vessel.

Retaining layer 12, of plastic foam material in place, is a fourth thin layer 13 of rigid glass fibre reinforced resin sheeting. This layer 13 forms the inner surfaces of the vessel.

To seat the escaped passengers or sailors, two circular rows of seats 14 and 14' are formed by a step around the side wall 15 of the vessel adjacent the end walls. One row 14 is situated just above the "floor" 13' and the other row 14' is situated upside down just below the "ceiling" 13'' of the vessel. If the vessel is somehow upended in a very agitated sea, the "upper" seats 14' assume a right-side-up position and the occupants of the vessel may continue to be seated. Safety belts (not shown) are provided for each one of the seats. Such safety belts are of the type used on passenger airplanes and can be easily released to permit the occupant to change seats.

Ventilation is provided for the vessel, consisting of a hole 16 in the end walls 2 and 3 of the vessel communicating with the interior. A valve 17 is movably positioned in the hole 16 and is attached at its inner end to a small handwheel 18 screwed into a fixed plate 19. Turning handwheel 18 will thus open or close valve 17. It is evident that whichever valve 17 is in contact with the water will be closed and the other "upper" valve opened for ventillation. Although valve 17 is shown, it is to be understood that the other modes of ventillation could be provided.

To gain access to the interior of the vessel, a hermetically sealable hatch door 20 is provided in the sidewall 15. Door 20 is provided with a handwheel 21 for opening and closing.

At least three portholes 22 are provided in the side wall 15 of vessel 1. They are spaced apart and located in the middle of the side wall.

Two vertically spaced-apart ropes 23, or grab lines, are also provided around the exterior of side wall 15 of the vessel, so that any person escaping from the endangered ship and falling into the water, will be able to grasp on to the rope 23 nearest the surface of the water and pull himself or herself to door 20 from where entry may be made into the vessel.

Figure 2:
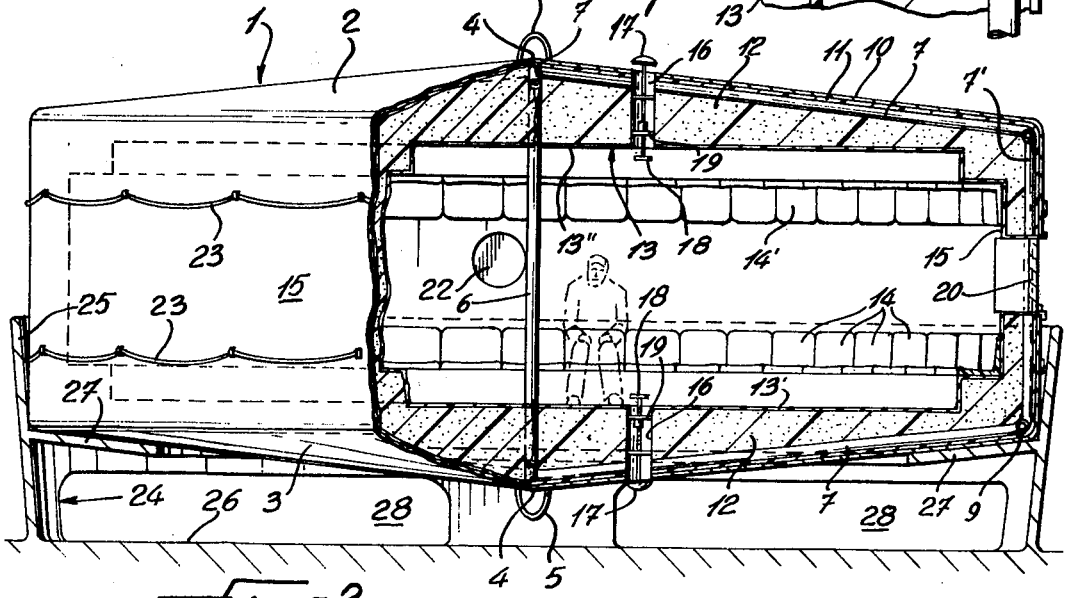
FIG. 2 is a side elevation of the vessel partially sectioned to show the construction and interior of the vessel.

Within the scope of the invention, a support 24 secured to the ship's deck is provided to hold the vessel in place ready for use. Many support structures 24 can be envisioned, but the one shown in FIG. 2 is characterized by an outwardly inclined circular side flange 25 rigidly secured to the ship's deck and an inclined annular flange 27 integral with side flange 25 and generally corresponding to the exterior sloping surfaces of end walls 2 or 3. Flange 27 effectively supports the vessel above the ship's deck 26. Openings 28 are provided under flange 27, so that, in case of the ship sinking, water will rush in under structure 24 and float the vessel off the ship's deck since it is not intended to anchor vessel 1 to support 24.

In practice, as soon as the ship's captain believes there exists a dangerous situation, he can order at least part of the crew to board one or more vessels 1, for the duration of this situation. Should the ship start to sink, the vessels 1 will simply float away. Radio equipment inside vessels 1 will enable to ask for rescue help.

What I claim is:

1. A life-saving apparatus consisting of a buoyant vessel generally in the shape of a hollow closed cylinder and of a rigid construction having a sidewall and two end walls, wherein said cylinder is provided with a hermetically-sealable door in its side wall, also provided with two ventilation apertures located in both end walls of said cylinder, further provided with a first rigidly-secured set of seats adjacent a first end wall, and a second rigidly secured set of seats adjacent said second end wall, said first set of seats being upside up and the second set of seats being upside down when said vessel is in a position such that said first end wall is the floor of said vessel, whereby said second set of seats assumes a lower upside-up position when said vessel is overturned in heavy seas, and said first row of seats assumes an upper, upside-down position, said cylinder being provided with a rigid skeletal structure consisting of a central pole, at least two radially-projecting members in each end wall of said cylinder and rigidly secured to said vertical pole, said radially-projecting members secured at their respective outer ends to a circular peripheral member located within the junction of the respective end walls with said side wall, and further consisting of additional poles, parallel to said central pole, extending within said side wall and interconnecting said circular peripheral members.

2. A life-saving apparatus as defined in claim 1, wherein the outer surfaces of both end walls are slightly conical and the center of both said outer surfaces is provided with a rigidly-secured rescue ring.

* * * * *